US010800007B2

(12) United States Patent
Hotani

(10) Patent No.: US 10,800,007 B2
(45) Date of Patent: Oct. 13, 2020

(54) ROLL SHAFT FOR BRUSH ROLL AND BRUSH ROLL

(71) Applicant: HOTANI CO., LTD., Wakayama (JP)

(72) Inventor: Akihiko Hotani, Wakayama (JP)

(73) Assignee: HOTANI CO., LTD., Wakayama (JP)

( * ) Notice: Subject to any disclaimer, the term of this patent is extended or adjusted under 35 U.S.C. 154(b) by 138 days.

(21) Appl. No.: 15/566,161

(22) PCT Filed: Jun. 5, 2017

(86) PCT No.: PCT/JP2017/020840
§ 371 (c)(1),
(2) Date: Oct. 12, 2017

(87) PCT Pub. No.: WO2018/142639
PCT Pub. Date: Aug. 9, 2018

(65) Prior Publication Data

US 2019/0047122 A1 Feb. 14, 2019

(30) Foreign Application Priority Data

Jan. 31, 2017 (JP) ..... 2017-015071

(51) Int. Cl.
*B24D 13/10* (2006.01)
*B24B 45/00* (2006.01)
(Continued)

(52) U.S. Cl.
CPC ..... *B24D 13/10* (2013.01); *A46B 3/10* (2013.01); *A46B 13/003* (2013.01); *B24B 23/04* (2013.01);
(Continued)

(58) Field of Classification Search
CPC ..... B24D 13/10; B24D 13/145; B24D 13/04; B24D 13/06; B24B 27/0076; B24B 7/12; B24B 45/00; A46B 3/10; A46B 13/003
(Continued)

(56) References Cited

U.S. PATENT DOCUMENTS 1,929,101 A * 10/1933 Schulte ..... B24B 7/12 451/131
4,993,198 A * 2/1991 Hotani ..... A46B 3/10 451/342
(Continued)

FOREIGN PATENT DOCUMENTS

JP S53-138970 A 12/1978
JP S57-305 A 1/1982
(Continued)

OTHER PUBLICATIONS

International Search Report dated Aug. 22, 2017 from International Application No. PCT/JP2017/020840, 4 pages.

*Primary Examiner* — Eileen P Morgan
(74) *Attorney, Agent, or Firm* — MH2 Technology Law Group, LLP

(57) ABSTRACT

The present invention provides a roll shaft having high corrosion resistance and rigidity against bending, and a brush roll comprising the roll shaft. The roll shaft 2 is for use in a brush roll 1 for brushing a strip of metal sheet. The roll shaft includes: a shaft body 7 to which multiple annular discs 4 having multiple brush bristles 5 implanted around the outer peripheral edge of the discs 4 are attached; key bases 8 attached to recessed grooves 72 provided on the outer peripheral edge of the shaft body 7, the key bases comprising keyways 80 into which insertion members 6 projecting from the inner peripheral edge of the annular discs 4 are fitted, and the key bases 8 comprising a corrosion-resistant
(Continued)

metallic material, a corrosion-resistant alloy, or a corrosion-resistant resin material.

13 Claims, 12 Drawing Sheets

(51) Int. Cl.

| | |
|---|---|
| ***A46B 3/10*** | (2006.01) |
| ***B24D 13/14*** | (2006.01) |
| ***B24B 23/04*** | (2006.01) |
| ***A46B 13/00*** | (2006.01) |
| *B24B 27/00* | (2006.01) |
| *B24D 13/04* | (2006.01) |

(52) U.S. Cl.
CPC ..... *B24B 45/00* (2013.01); *B24D 13/145* (2013.01); *B24B 27/0076* (2013.01); *B24D 13/04* (2013.01)

(58) Field of Classification Search
USPC ..... 451/342, 907
See application file for complete search history.

(56) References Cited

U.S. PATENT DOCUMENTS

| | | | | |
|---|---|---|---|---|
| 2004/0040399 | A1* | 3/2004 | Kamimura | B24B 23/02 74/443 |
| 2012/0292160 | A1* | 11/2012 | Arai | B65G 15/54 198/835 |

FOREIGN PATENT DOCUMENTS

| | | | | | |
|---|---|---|---|---|---|
| JP | S59-219164 | A | | 12/1984 | |
| JP | S60-127975 | A | | 7/1985 | |
| JP | 01103268 | A | * | 4/1989 | A46B 3/10 |
| JP | H01-103268 | A | | 4/1989 | |
| JP | H10-291165 | A | | 11/1998 | |
| JP | 2011-141034 | A | | 7/2011 | |
| JP | 2013-193195 | A | | 9/2013 | |
| WO | WO-0018545 | A1 | * | 4/2000 | A46B 13/003 |

* cited by examiner

ROLL SHAFT FOR BRUSH ROLL AND BRUSH ROLL

CROSS-REFERENCE TO RELATED APPLICATIONS

This application is a U.S. National Stage application of PCT/JP2017/020840 filed 5 Jun. 2017, which claims priority to Japanese Application No. 2017-015071 filed 31 Jan. 2017, the entire disclosures of which are hereby incorporated by reference in their entireties.

TECHNICAL FIELD

The present invention relates to a roll shaft for brush rolls used in brushing (e.g., cleaning, polishing, grinding) a strip of metal sheet, such as a steel sheet or a copper sheet (hereinafter referred to as a "strip"), and to a brush roll comprising the roll shaft.

BACKGROUND ART

As this type of brush roll, a brush roll in which annular discs having many brush bristles implanted around the outer peripheral edge of the discs are attached to a metal roll shaft in such a manner that multiple annular discs are stacked in the axial direction of the shaft is known (see, for example, Patent Literature (PTL) 1). The multiple annular discs are attached to the roll shaft by fitting the roll shaft into the inner opening of the annular discs while performing positioning (center alignment) of the annular discs relative to the roll shaft by fitting insertion members (keys), which project from multiple locations on the inner peripheral edge of each annular disc, into keyways, which are formed at multiple locations on the outer peripheral surface of the roll shaft, so as to engage the insertion members with the roll shaft.

CITATION LIST

Patent Literature

PTL 1: JPH10-291165A

SUMMARY OF INVENTION

Technical Problem

The keyways formed on the outer circumferential surface of a roll shaft corrode and deform with use of a brush roll. If this occurs, engagement of the annular discs with the roll shaft is weakened and high-precision positioning (center alignment) of annular discs relative to the roll shaft becomes impossible. As a result, if axial run-out of the brush roll occurs, high-precision polishing, etc., of a strip cannot be performed, thus leading to quality deterioration. Therefore, stainless steel that has excellent corrosion resistance is considered to be used as a material for roll shafts. However, using stainless steel as a roll shaft material increases the material cost of the roll shaft. Furthermore, when a brush roll is used, an alternating load always acts on the roll shaft at a considerably high frequency of about 1200 times per minute. Accordingly, the roll shaft is required to have a high rigidity (strength) against deformation due to bending. Stainless steel has low rigidity against bending. When stainless steel is used as a roll shaft material, bending of the roll shaft must be frequently corrected. As one solution, plating, painting, and like coating for anticorrosion may be considered on the surface of the keyways of a roll shaft. However, plating cannot be used because the plating film is easily peeled off under an environment in which an alternating load is always applied. Painting also cannot be used because high-precision processing of keyways is required for the center alignment of annular discs relative to the roll shaft as described above and the high-precision processing is difficult to achieve with painting.

The present invention was made in view of the above problem. An object of the present invention is to provide a roll shaft that has high corrosion resistance and rigidity against bending, and a brush roll comprising the roll shaft.

Solution to Problem

The object of the present invention can be achieved by a roll shaft for use in a brush roll for brushing a strip of metal sheet, the shaft comprising:

a shaft body to which annular discs having multiple brush bristles implanted around the outer peripheral edge thereof are attached; and key bases attached to recessed grooves provided on the outer peripheral surface of the shaft body, the key bases comprising keyways into which insertion members projecting from the inner peripheral edge of the annular discs are fitted, and the key bases comprising a corrosion-resistant metallic material, a corrosion-resistant alloy, or a corrosion-resistant resin material.

In the roll shaft thus configured, the key bases are preferably acid-resistant.

In the roll shaft thus configured, the key bases preferably comprise stainless steel.

In the roll shaft thus configured, the key bases preferably comprise a plastic or FRP.

In the roll shaft thus configured, preferably, first insertion holes are provided on the groove bottom of the recessed grooves of the shaft body; second insertion holes are provided on the surface of the key bases opposite to the keyway side; and the key bases are preferably attached to the shaft body via connecting members fitted into the first insertion holes and the second insertion holes.

In the roll shaft thus configured, preferably, screw holes are provided on the groove bottom of the recessed grooves of the shaft body, bolt insertion holes are provided on the groove bottom of the keyways of the key bases, and the key bases are fixed to the shaft body by bolts.

The object of the present invention can also be achieved by a brush roll comprising: multiple annular discs having multiple brush bristles implanted around the outer peripheral edge of each annular disc; and a roll shaft configured as described above to which the multiple annular discs are attached in such a manner that the multiple annular discs are stacked side-by-side in the axial direction.

Advantageous Effects of Invention

According to the present invention, a roll shaft is formed by incorporating corrosion-resistant key bases comprising keyways into a shaft body having high rigidity (strength) against bending. This suppresses bending deformation of the roll shaft and also inhibits deformation due to corrosion of keyways with the use of a brush roll. As a result, engagement of annular discs with the roll shaft is maintained and high-precision positioning (center alignment) of the annular discs relative to the roll shaft can be achieved over a long period of time. Thus, the brush roll can be prevented from axial run-out, and high-precision scouring, etc., of a strip or the like can be performed, thus maintaining high quality.

DESCRIPTION OF EMBODIMENTS

Figure 1:
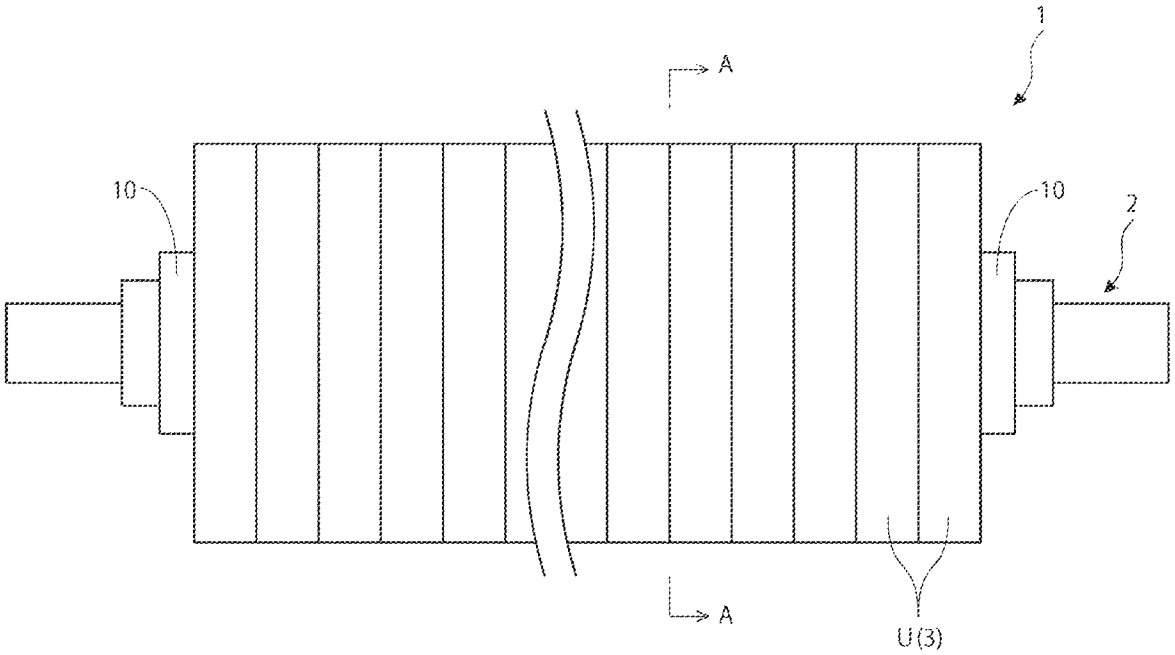
FIG. 1 is a front view schematically showing a brush roll according to one embodiment of the present invention.
Figure 2:
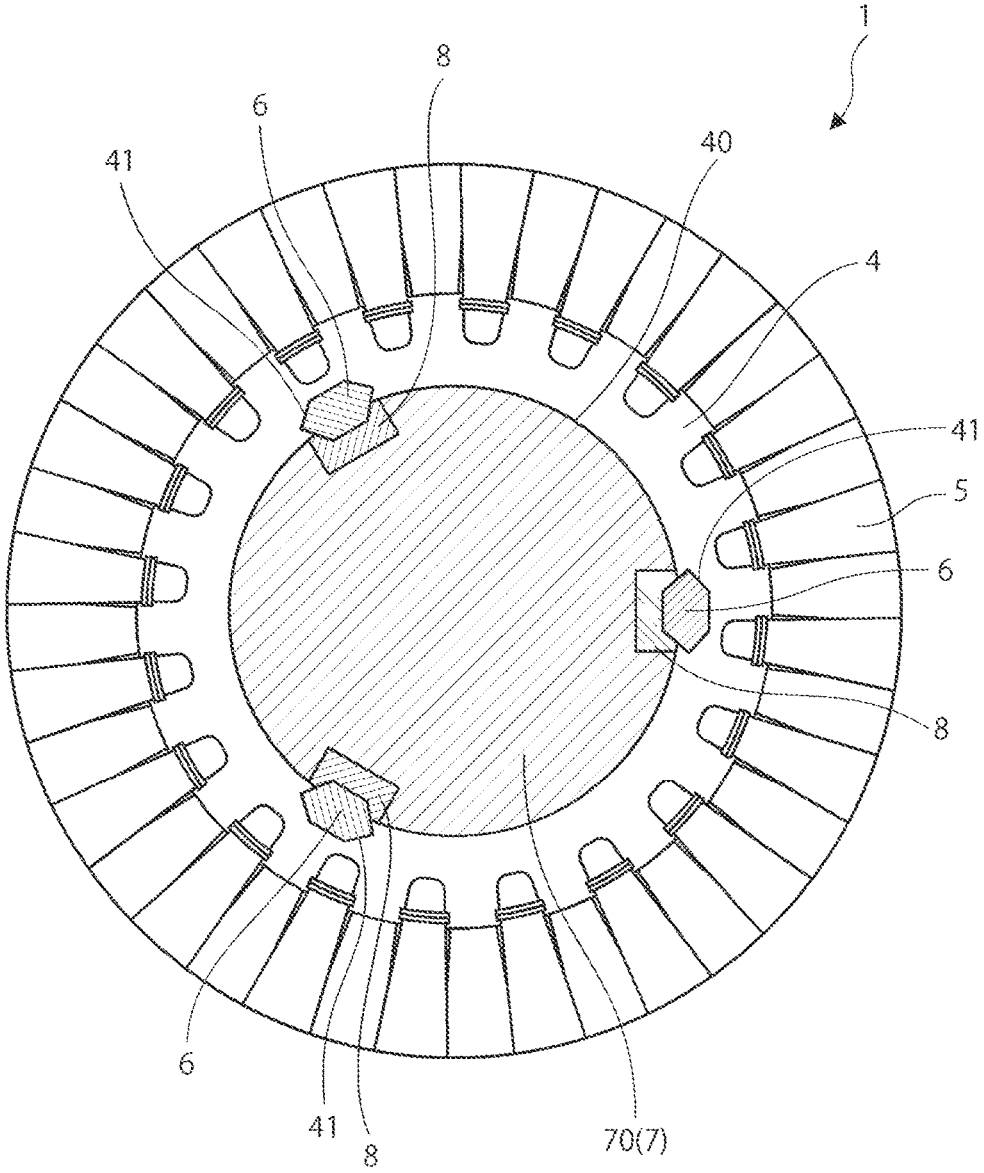
FIG. 2 is a sectional view taken along line A-A in FIG. 1.

Embodiments of the present invention will be described below with reference to the accompanying drawings. FIGS. 1 and 2 schematically show a brush roll 1 according to one embodiment of the present invention. The brush roll 1 is used for brushing (cleaning, polishing, grinding) a strip of metal sheet (strip), such as an iron sheet, a steel sheet, an aluminum sheet, or a copper sheet, or a temper rolling roll for strips or a back-up roll thereof.

Figure 3:
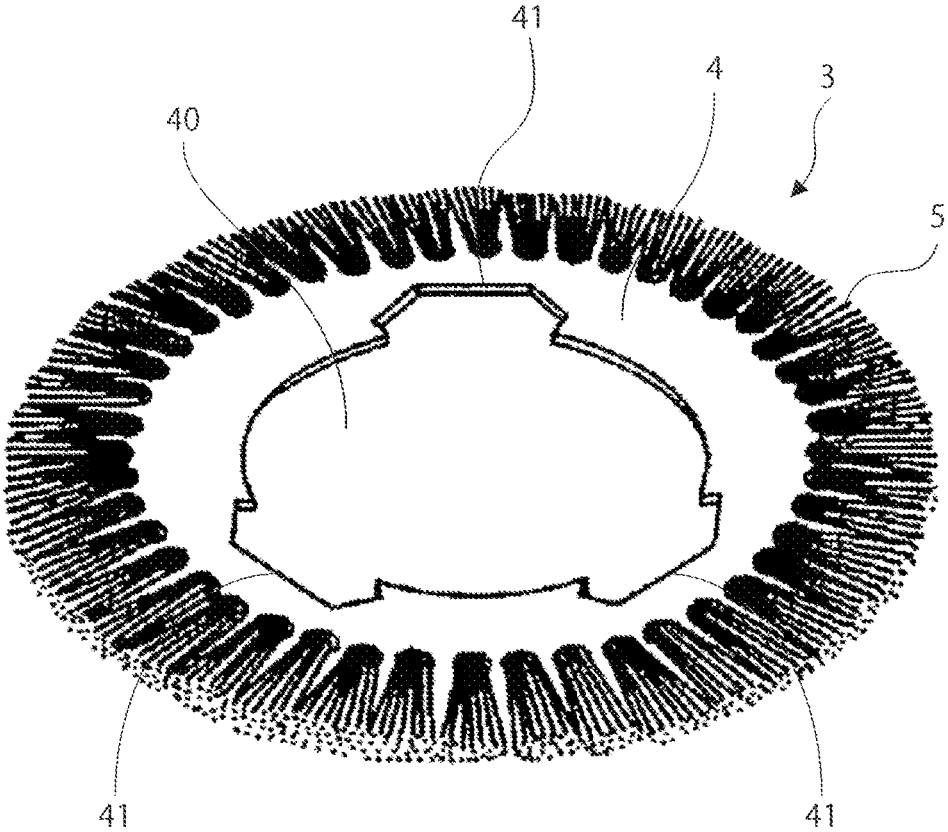
FIG. 3 is a perspective view of a brush disc.
Figure 4:
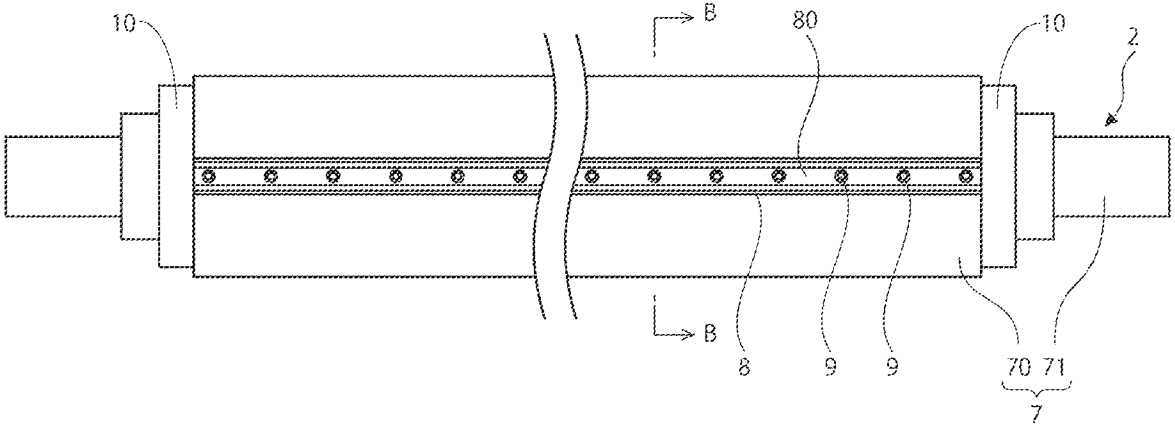
FIG. 4 is a front view schematically showing a roll shaft.

The brush roll 1 comprises brush discs 3 shown in FIG. 3 and a metal roll shaft 2 shown in FIG. 4, the brush discs 3 being attached via insertion members 6 (keys) to the roll shaft 2 in such a manner that multiple brush discs 3 are stacked side-by-side in the axial direction and concurrently rotatable. In the present embodiment, a plurality of brush cassettes U formed by stacking multiple brush discs 3 and forming the discs 3 into a block are attached to the roll shaft 2 in such a manner that multiple brush discs 3 are stacked side-by-side in the axial direction and concurrently rotatable. The multiple brush discs 3 stacked side-by-side are compressed from both sides by flanges 10 and tightened for integration.

Each brush disc 3 is configured such that many brush bristles 5 are densely implanted around the outer peripheral edge of an annular disc 4. The brush bristles 5 are passed through holes (not shown) that pierce the outer peripheral portions of the annular disc 4, and folded into a horseshoe shape. The folded brush bristle anchor portions are then tightened with a metal wire so as to fix many brush bristles 5 on the outer peripheral edge of the annular disc 4.

Examples of brush bristles 5 include monofilaments having a diameter of 0.02 mm to 7 mm and made of a synthetic resin, such as nylon, polyester (e.g., polyethylene terephthalate, polybutylene terephthalate), or polyolefin (e.g., polypropylene); and such monofilaments having a diameter of 0.02 mm to 7 mm and made of a synthetic resin as described above and further containing abrasive grains (e.g., alumina, silica). Other examples of preferable brush bristles 5 include bristles formed by spirally winding multiple ultrafine multifilaments of a synthetic resin, such as nylon, polyester, or polyolefin, around the circumferential surface of a core thread formed of a bundle of relatively fine monofilaments, in all the portions other than the tip of the core thread, or by braiding such multifilaments, and then fixing the multifilaments with an adhesive made of a synthetic resin. The brush bristles are configured to have a thick root, which is due to the bundling of multiple monofilaments, and have a fine tip, which is due to a debundled state of multiple fine monofilaments. With this configuration, the thick root ensures the strength of brush bristles 5, whereas the fine tip allows the removal of fine dirt or stains from the surface of a strip or the like.

The annular disc 4 comprises a disc-shaped iron sheet of a specific thickness having a circular opening (hole) 40 at the center of the sheet. Multiple (three in the present embodiment) accommodation recesses 41 for accommodating insertion members (keys) 6 are provided on the inner circumferential surface of the annular disc 4 in a circumferentially equally spaced manner.

In order to insert the roll shaft 2 through the opening 40, the annular disc 4 is designed to have an inner diameter that is slightly larger than the outer diameter of the shaft body 7, which has the largest outer diameter of the roll shaft 2. Accordingly, there is a clearance between the inner circumferential surface of the annular disc 4 and the outer circumferential surface of the shaft body 7. If a clearance exists around the entire periphery of the shaft body 7, axial run-out will occur in the annular disc 4 relative to the roll shaft 2. Accordingly, the brush roll 1 is configured to partially eliminate the clearance between the outer circumferential surface of the shaft body 7 and the inner circumferential surface of the annular disc 4 so as to engage insertion members 6 projecting from the inner circumferential surface of the annular disc 4 with the roll shaft 2 for positioning (center alignment) of the annular disc 4 relative to the roll shaft 2. Therefore, multiple (three in the present embodiment) keyways 80 engaged with insertion members 6 are provided on the outer circumferential surface of the roll shaft 2 in a circumferentially equally spaced manner, as described in detail below.

The insertion members 6 are formed, for example, using fiber-reinforced plastic (FRP). Known insertion members, such as the insertion member disclosed in JPH10-291165A, can be used. One insertion member 6 is provided per brush cassette U, which is a block of multiple annular discs 4.

Figure 5:
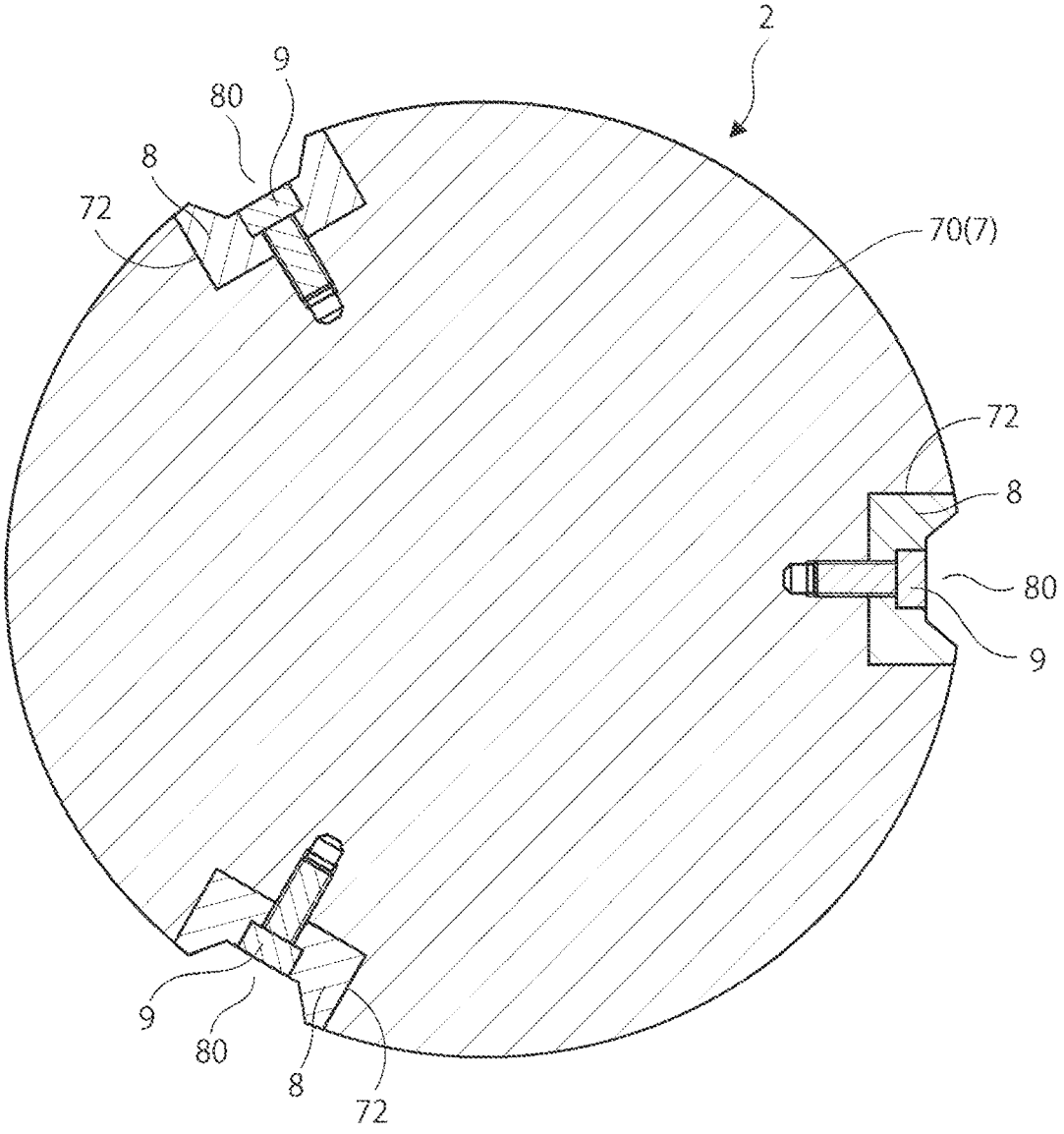
FIG. 5 is a sectional view taken along line B-B in FIG. 4.

The roll shaft 2 comprises a shaft body 7 to which multiple annular discs 4 are attached, and key bases 8, which are attached to recessed grooves 72 (shown in FIG. 5) provided on the outer circumferential surface of the shaft body 7.

The shaft body 7 comprises a substantially cylindrical body 70 having a large outer diameter and a pair of substantially cylindrical attachments 71 having a small outer diameter, which are integrally provided on both ends of the cylindrical body 70. The body 70 is a portion to which multiple annular discs 4 are attached. The attachments 71 are portions set on the bearings of a brushing equipment (not shown). The shaft body 7 can be formed, for example, using steel, high-carbon steel, or like materials generally used for roll shafts, that is, materials having rigidity (strength) against deformation due to bending caused by an alternating load, which acts on the shaft during the use of a brush roll 1. The outer circumferential surface of the shaft body 7 is coated with an epoxy resin coating composition, a urethane resin coating composition, or the like to enhance corrosion resistance.

On the outer circumferential surface of the body 70, multiple (three in the present embodiment) recessed grooves 72 extending along the axial direction are formed in a circumferentially equally spaced manner. The recessed grooves 72 are configured to allow key bases 8 to be fitted therein (rectangular in cross-section). In the present embodiment, screw holes 73 are provided on the groove bottom 72A. Multiple screw holes 73 are provided on the groove bottom 72A of each recessed groove 72 in an axially spaced manner.

The key base 8 has an axially extending substantially quadrangular shape and comprises an axially extending keyway 80 formed at the widthwise central position. An insertion member 6 projecting from the inner peripheral edge of the annular disc 4 is fitted into the keyway 80. Accordingly, the keyway 80 is shaped according to the contour of the portion projecting from the inner peripheral edge of the annular disc 4. In the present embodiment, the keyway 80 is inverted-trapezoidal in cross-section.

Bolt insertion holes 81 are provided on the groove bottom 80A of the keyways 80. Multiple bolt insertion holes 81 are provided on the groove bottom 80A of each keyway 80 in an axially spaced manner. The key bases 8 are fitted into the recessed grooves 70 of the shaft body 7 in such a manner that the bolt insertion holes 81 are aligned with the screw holes 73, and fixed by bolts 9. The bolt 9, bolt insertion hole 81, and screw hole 73 are designed so that the head 90 of the bolt 9 is flush with the groove bottom 80A of the keyway 80.

The key bases 8 are formed using a corrosion-resistant metallic material, a corrosion-resistant alloy material, or a corrosion-resistant resin material. "Corrosion resistant" as used herein refers to a property of being less susceptible to corrosion (rusting) and less susceptible to oxidation. The key bases 8 formed using a corrosion-resistant material can inhibit keyways 80 of the roll shaft 2 from deformation due to corrosion that occurs with the use of a brush roll 1. As a result, engagement of the annular discs 4 with the roll shaft 2 is maintained, and high-precision positioning (center alignment) of the annular discs 4 relative to the roll shaft 2 can be achieved over a long period of time.

Examples of corrosion-resistant metal materials include titanium, nickel, aluminum, chromium, and the like. Examples of corrosion-resistant alloy materials include stainless steel, titanium alloy, nickel alloy, aluminum alloy, chromium alloy, and the like. Stainless steel, titanium, and titanium alloy are preferable from the viewpoint of corrosion resistance and cost. Stainless steel is more preferable from the viewpoint of processability.

Examples of corrosion-resistant resin materials include plastics, such as polypropylene, polyvinyl chloride, polyethylene, fluororesin, and polyamide; fiber-reinforced plastics (FRP); and the like. Polyvinyl chloride and fiber-reinforced plastics (FRP) are preferable from the viewpoint of corrosion resistance and cost. Polyvinyl chloride is more preferable from the viewpoint of cost.

Further, because the brush roll 1 is assumed to be used in an acid atmosphere, the key base 8 is preferably resistant to acids, that is, the key base 8 preferably comprises an acid-resistant material. The acid resistance may be, for example, a level of resistance at which when the key base 8 is immersed in a 1% aqueous hydrochloric acid solution for 100 hours, degradation is not observed with the naked eye. Examples of acid-resistant materials include plastic, fiber-reinforced plastic (FRP), and the like.

The configuration of the roll shaft 2 is not limited to those described above. Persons skilled in the art can suitably employ various other configurations or configuration modifications as required for preferable use as a brush roll 1.

Figure 6:
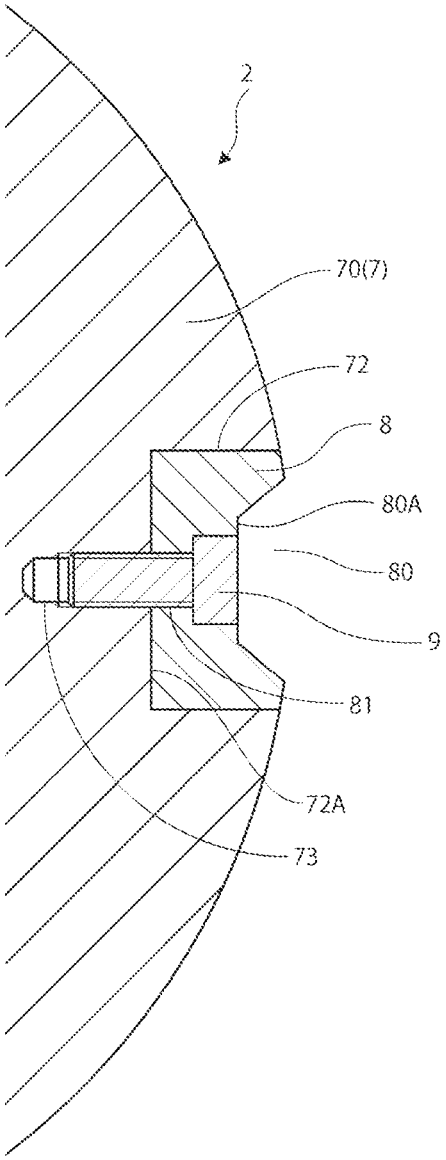
FIG. 6 is an enlarged view of the main part in FIG. 5.
Figure 7:
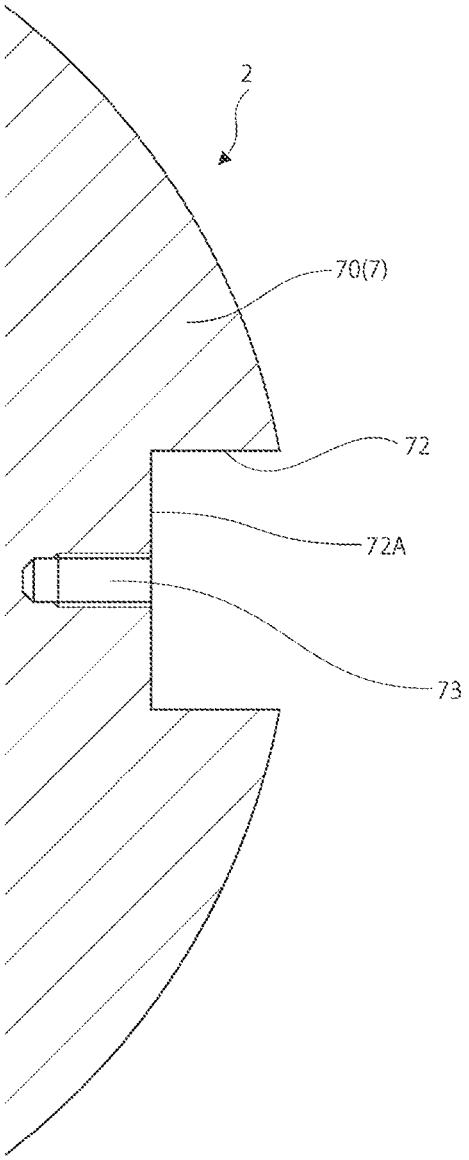
FIG. 7 shows a procedure for fixing a key base to a shaft body.
Figure 8:
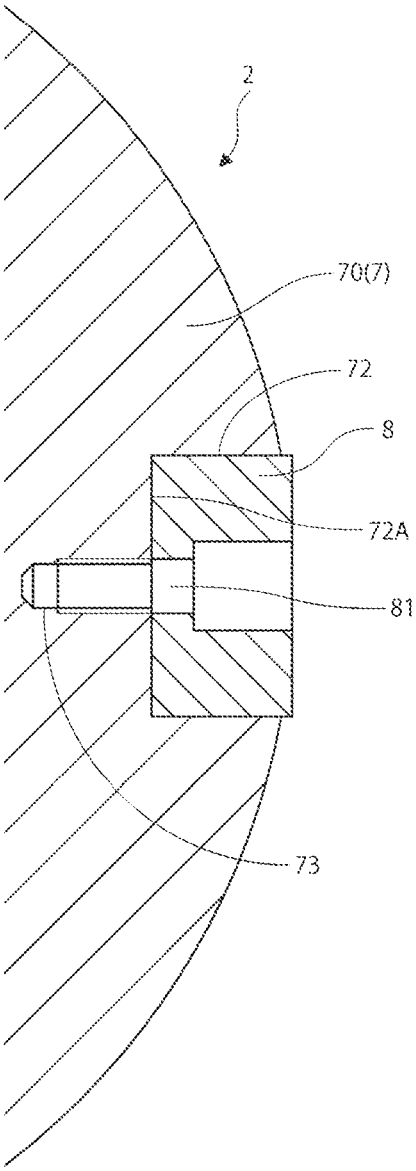
FIG. 8 shows a procedure for fixing a key base to a shaft body.

Next, the method for producing the roll shaft 2 according to the present embodiment is described. First, a roll shaft 2 comprising a cylindrical shaft body 7 is prepared. As shown in FIG. 7, multiple recessed grooves 72 are formed on the outer peripheral surface of the shaft body 7 (body part 70) in a circumferentially equally spaced manner, and screw holes 73 are formed on the groove bottom 72A of each recessed groove 72. Next, as shown in FIG. 8, key bases 8 having bolt insertion holes 81 are fitted into recessed grooves 72. As shown in FIG. 6, each key base 8 is fixed by a bolt 9, and the bolt-fixed key base 8 is subjected to V-groove processing to form a keyway 80. At the locations of key bases 8, processing is performed so as to make the outer diameter of the shaft body 7 uniform. A roll shaft 2 according to the present embodiment is thereby produced.

Figure 9:
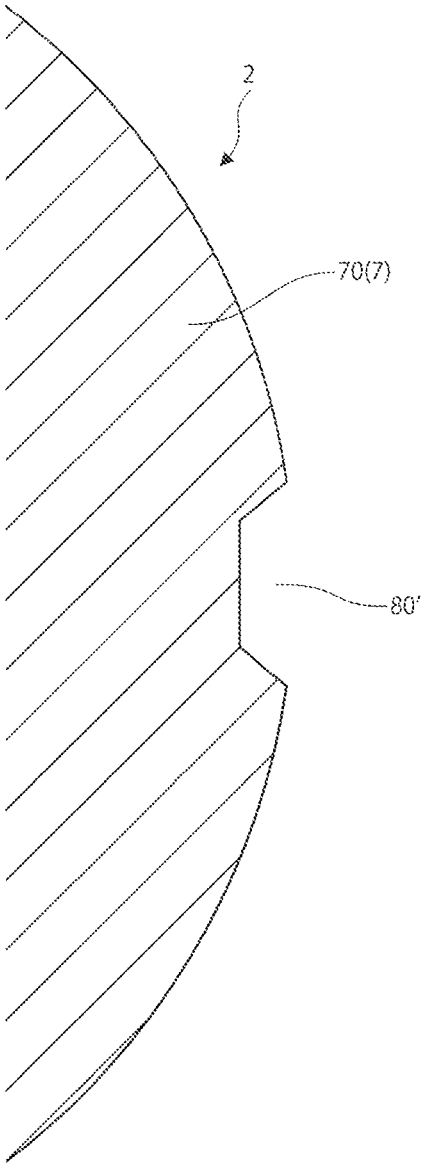
FIG. 9 shows a procedure for fixing a key base to a shaft body of a conventional roll shaft.

The roll shaft 2 according to the present embodiment can also be produced by using a roll shaft 2 comprising keyways 80' formed on the outer peripheral surface of the shaft body 7 such as that conventionally used as a roll shaft for brush rolls, as shown in FIG. 9. Specifically, multiple recessed grooves 72 and screw holes 73 are formed in a circumferentially equally spaced manner on the outer peripheral surface of the shaft body 7 (body 70) in such a manner as to bore the keyways 80', thus leading to the state shown in FIG. 7. The subsequent steps are the same as above. As shown in FIGS. 8 and 6, key bases 8 having bolt insertion holes 81 are fitted into the recessed grooves 72 and fixed by bolts 9, and the bolt-fixed key bases 8 are subjected to V-groove processing to form keyways 80. At the locations of the key bases 8, processing is performed so that the outer diameter of the shaft body 7 is made uniform. A roll shaft 2 according to this embodiment is thereby produced.

Thus, according to the roll shaft 2 of this embodiment, the shaft body 7 is formed using a material having a rigidity (strength) against bending. Therefore, even when an alternating load always acts on the roll shaft 2 during the use of a brush roll 1, the roll shaft hardly deforms and frequent correction of the bending of the roll shaft 2 is unnecessary. Furthermore, since the roll shaft 2 is formed by incorporating corrosion-resistant key bases 8 comprising keyways 80 into the shaft body 7, deformation due to corrosion of the keyways 80, which may occur with the use of a brush roll 1, can be prevented. As a result, the engagement of the annular discs 4 with the roll shaft 2 is maintained, and high-precision positioning (center alignment) of the annular discs 4 relative to the roll shaft 2 can be achieved over a long period of time. This prevents the brush roll 1 from axial run-out and enables high-precision scouring, etc., of a strip or the like, thus maintaining good quality.

As described above, the roll shaft 2 according to the present embodiment has high corrosion resistance and rigidity against bending, and thus can be used over a long period without any problem.

Further, since the key bases 8 are formed using an acid-resistant material, the brush roll 1 can be used even in a strong acid atmosphere.

An embodiment of the present invention is described above. However, it should be understood that the present invention is not limited to the embodiment described above, and various modifications can be made without departing from the spirit of the invention.

Figure 10:
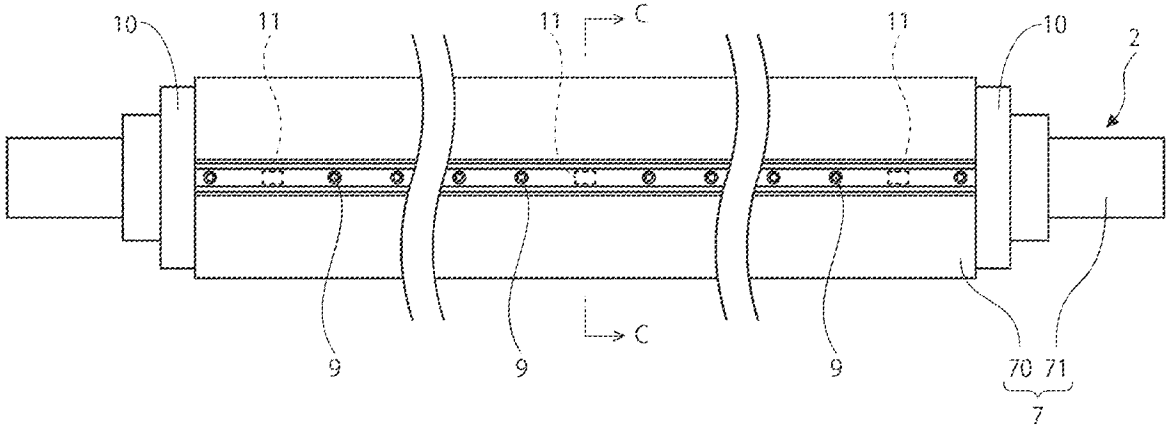
FIG. 10 is a front view schematically showing a modified example of the roll shaft.
Figure 11:
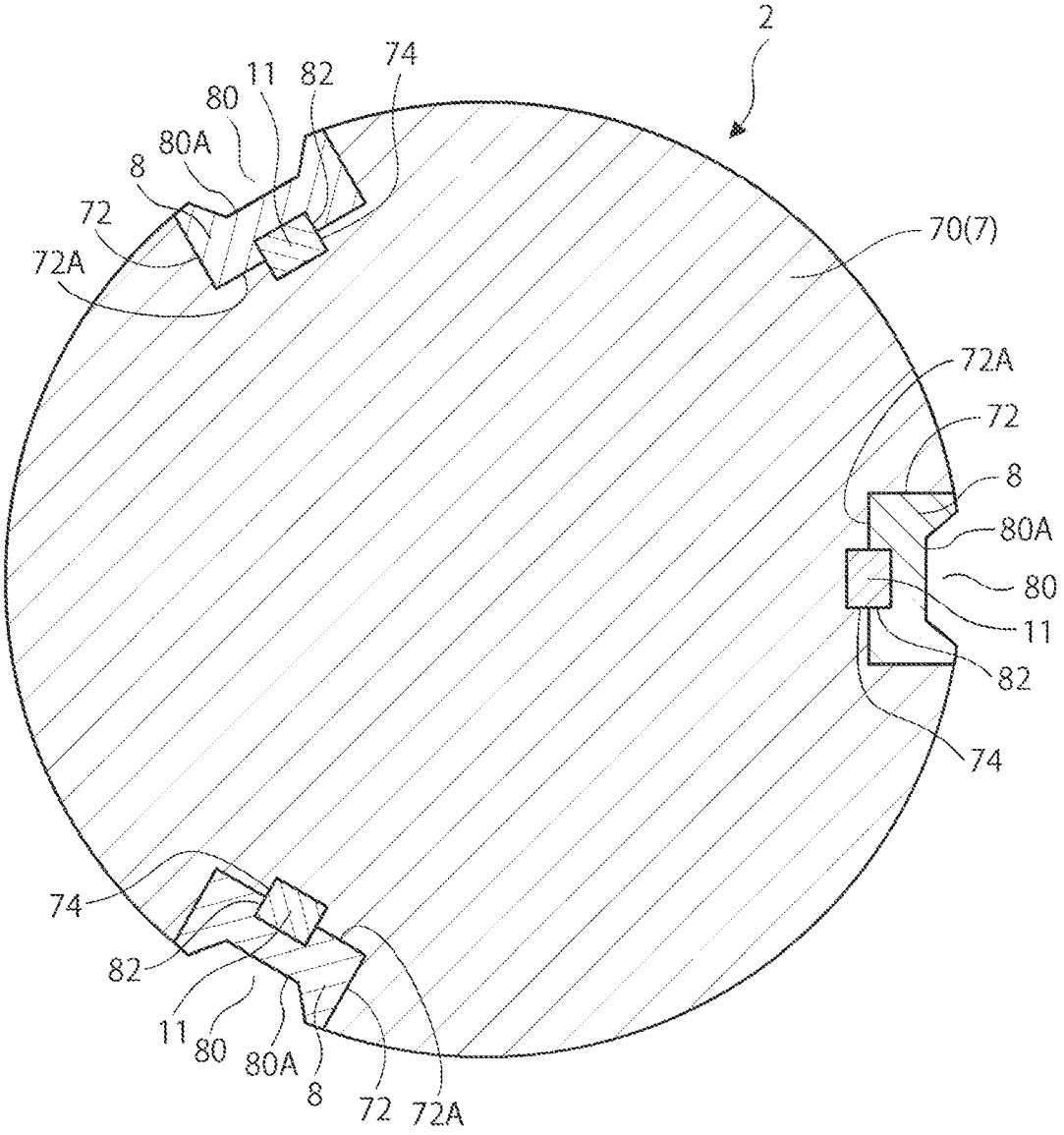
FIG. 11 is a sectional view taken along line C-C in FIG. 10.

For example, in the above embodiment, the key bases 8 are fixed to the shaft body 7 (body 70) only using bolts 9. As shown in FIGS. 10 and 11, connecting members 11 may be used in addition to the bolts 9, and the key bases 8 may be fixed to the shaft body 7 (body 70) via connecting members 11. Specifically, as shown in FIGS. 10 and 11, the key bases 8 may be attached to the shaft body 7 (body 70) via connecting members 11 and fixed to the shaft body 7 (body 70) using bolts 9.

In the roll shaft 2 shown in FIGS. 10 and 11, multiple screw holes 73 are formed at spaced locations on the groove bottom 72A of each recessed groove 72 of the shaft body 7, whereas multiple (three in the present embodiment) first insertion holes 74 are interspersed among multiple screw holes 73. Since connecting members 11 are fitted into first insertion holes 74, the first insertion holes 74 are shaped according to the contour of the lower portion of the connecting members 11. In the present embodiment, the first insertion holes 74 are rectangular in cross-section. Multiple first insertion holes 74 are provided at specific locations of each recessed groove 72. In the present embodiment, one first insertion hole 74 is provided at the axially central position of the recessed groove 72, and a pair of first insertion holes 74 are provided in the vicinity of the axial ends of the recessed groove 72.

Each key base 8 has multiple (three in the present embodiment) second insertion holes 82 provided on its surface opposite to the side of the keyway 80, at the locations corresponding to the first insertion holes 74 of the recessed groove 72 of the shaft body 7. Since the connecting members 11 are also fitted into the second insertion holes 82, the second insertion holes 82 are shaped according to the contour of the upper portion of the connection members 11. In the present embodiment, the second insertion holes 82 are rectangular in cross-section.

Figure 12:
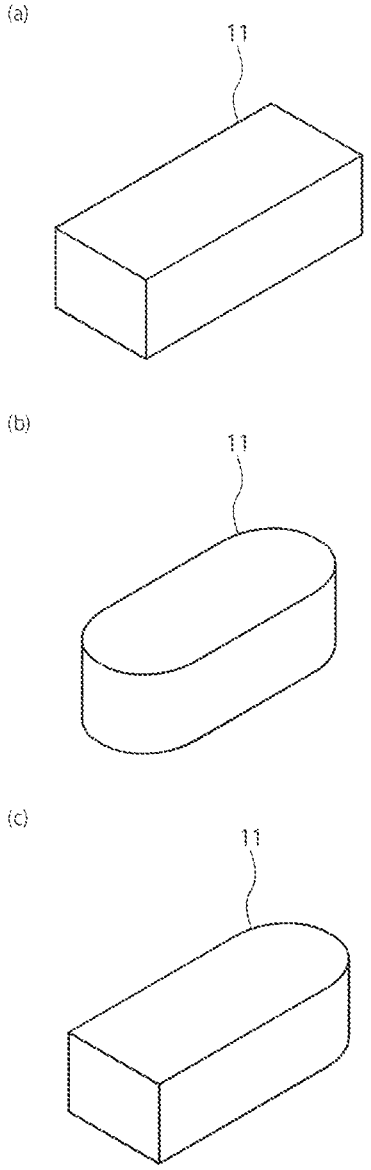
FIG. 12 is a perspective view showing the appearance of a connecting member.

The connecting member 11 is a member for connecting the key base 8 to the shaft body 7 (body 70). The connecting member 11 is formed, for example, using a material such as steel, high carbon steel, or stainless steel. For example, both ends of the connecting member 11 may be angular as shown in FIG. 12 (A) or may be round as shown in FIG. 12 (B). Alternatively, either end of the connecting member 11 may be round as shown in FIG. 12 (C). However, connecting members 11 are not limited to these, and various shapes of connecting members 11 can be used.

The engagement of the connecting member 11 with the key base 8 and with the shaft body 7 (body 70) enables the key base 8 and the shaft body 7 to be connected together in a positioned state without circumferential or axial run-out of the key base 8 relative to the shaft body 7 (body 70). As a result, the bolt insertion holes 81 of the key base 8 are naturally aligned with the screw holes 73 of the recessed groove 72 of the shaft body 7 (body 70) and can be easily fixed by bolts 9. Furthermore, if the key base 8 is fixed to the shaft body 7 (body 70) by bolts 9, a load applied during rolling of the roll shaft 2 acts on the bolts 9, and an excessive load is applied to the bolts 9 when the brush roll 1 is used. In contrast, using connecting members 11 can disperse the load acting on the bolts 9. Thus, since the load applied to the bolts 9 can be reduced, damage, etc., to the bolts 9 can be suppressed, so that the brush roll 1 can be maintained in a high quality state over a long period of time.

The multiple insertion holes 74 are not necessarily formed at an axially central position of the recessed groove 72 and in the vicinity of the axial ends. As long as the load acting on the bolts 9 can be dispersed by connecting members 11, an appropriate number of insertion holes can be formed at appropriate locations of each recessed groove 72.

In the above embodiment, the key bases 8 are fixed to the shaft body 7 (body 70) using bolts 9. However, as long as the key bases 8 can be firmly fixed to the recessed grooves 72 of the shaft body 7, bolts 9 do not always have to be used to fix the key bases 8. In this case, the screw holes 73 and the bolt insertion holes 81 can be omitted, and other fixing means and/or fixing methods can be used to fix the key bases 8.

DESCRIPTION OF THE REFERENCE NUMERALS

1: Brush roll
2: Roll shaft
4: Annular disc
5: Brush bristles
6: Insertion member (key)
7: Shaft body
8: Key base
9: Bolt
11: Connecting member
72: Recessed groove
72A: Groove bottom of recessed groove
73: Screw hole
74: First insertion hole
80: Keyway
80A: Groove bottom of keyway
81: Bolt insertion hole
82: Second insertion hole

The invention claimed is:

1. A roll shaft for use in brush rolls for brushing a strip of metal sheet, the shaft comprising:

a shaft body to which annular discs having multiple brush bristles implanted around an outer peripheral edge thereof are attached;

key bases attached to recessed grooves provided on an outer peripheral surface of the shaft body, the key bases comprising keyways into which insertion members projecting from an inner peripheral edge of the annular discs are fitted, and the key bases comprising a corrosion-resistant metallic material, a corrosion-resistant alloy, or a corrosion-resistant resin material; and connecting members for connecting the key bases and the shaft body;

wherein first insertion holes are provided on a groove bottom of the recessed grooves of the shaft body;

second insertion holes are provided on a surface of the key bases opposite to a side of the keyways, wherein the second insertion holes are not disposed through the key bases to the keyways;

the connecting members are fitted into the first insertion holes and the second insertion holes in a state of being sandwiched between a bottom surface of the first insertion hole and a bottom surface of the second insertion hole; and wherein screw holes are provided on the groove bottom of the recessed grooves of the shaft body;

bolt insertion holes are disposed through the key bases in such a manner that the bolt insertion holes are aligned with the screw holes, wherein the screw holes and bolt insertion holes are separate from the first and second insertion holes; and the key bases are fixed to the shaft body by bolts disposed in the screw holes and bolt insertion holes.

2. The roll shaft according to claim 1, wherein the key bases are acid-resistant.

3. The roll shaft according to claim 1, wherein the key bases are formed of stainless steel.

4. The roll shaft according to claim 1, wherein the key bases are formed of plastic or FRP.

5. A brush roll comprising:

multiple annular discs having multiple brush bristles implanted around the outer peripheral edge thereof; and the roll shaft according to claim 1 to which the annular discs are attached via insertion members in such a manner that the annular discs are stacked side-by-side in an axial direction.

6. The roll shaft according to claim 1, wherein the connecting members are fitted into the first insertion holes and the second insertion holes such that the key bases and the shaft body are connected together in a positioned state without circumferential or axial run-out of the key base relative to the shaft body.

7. A roll shaft for use in brush rolls for brushing a strip of metal sheet, the roll shaft comprising:

a shaft body comprising recessed grooves provided on an outer peripheral surface of the shaft body, wherein first insertion holes are provided on a groove bottom of the recessed grooves of the shaft body;

key bases attached to the recessed grooves, wherein the key bases comprise keyways, wherein second insertion holes are provided on a surface of the key bases opposite to a side of the keyways, and wherein the second insertion holes are not disposed through the key bases to the keyways;

connecting members connecting the key bases and the shaft body, wherein the connecting members are fitted into the first insertion holes and the second insertion holes such that the key bases and the shaft body are connected together in a positioned state without circumferential or axial run-out of the key base relative to the shaft body; and, annular discs comprising multiple brush bristles implanted around an outer peripheral edge of the annular discs and insertion members projecting from an inner peripheral edge of the annular discs, wherein the insertion members are fitted into the keyways to attach the annular discs to the shaft body.

8. The roll shaft according to claim 7, further comprising:

screw holes provided on the groove bottom of the recessed grooves of the shaft body;

bolt insertion holes disposed through the key bases in such a manner that the bolt insertion holes are aligned with the screw holes, wherein the screw holes and bolt insertion holes are separate from the first and second insertion holes; and the key bases are fixed to the shaft body by bolts disposed in the screw holes and bolt insertion holes.

9. The roll shaft according to claim 7, wherein the key bases comprise a corrosion-resistant metallic material, a corrosion-resistant alloy, or a corrosion-resistant resin material.

10. The roll shaft according to claim 7, wherein the key bases are acid-resistant.

11. The roll shaft according to claim 7, wherein the key bases are formed of stainless steel.

12. The roll shaft according to claim 7, wherein the key bases are formed of plastic or FRP.

13. The roll shaft according to claim 7, wherein the annular discs are stacked side-by-side in an axial direction.

* * * * *